United States Patent [19]

Atkins et al.

[11] 4,122,890

[45] Oct. 31, 1978

[54] NOZZLE FOR THE CONTINUOUS CASTING OF LEAD

[75] Inventors: Larry P. Atkins, Daleville; James R. Bish, Anderson, both of Ind.

[73] Assignee: General Motors Corporation, Detroit, Mich.

[21] Appl. No.: 819,896

[22] Filed: Jul. 28, 1977

[51] Int. Cl.[2] ..... B22D 11/124; B22D 11/10

[52] U.S. Cl. ..... 164/444; 164/439; 165/DIG. 11

[58] Field of Search ..... 165/DIG. 11; 164/82, 164/89, 436, 437, 439, 438, 440, 443, 444

[56] References Cited

U.S. PATENT DOCUMENTS

| | | | |
|---|---|---|---|
| 3,098,269 | 7/1963 | Baier | 164/444 |
| 3,390,716 | 7/1968 | Rossing | 164/440 X |
| 3,844,343 | 10/1974 | Burggraf | 165/DIG. 11 |

*Primary Examiner*—Francis S. Husar
*Assistant Examiner*—John S. Brown
*Attorney, Agent, or Firm*—Lawrence B. Plant

[57] ABSTRACT

A continuous casting nozzle for lead strip adapted for cooling with water or the like. Primary and secondary cooling channels are arranged in paralleling relation and intercommunicated by a plurality of ports which direct turbulent streams of water from the secondary cooling channel against the hot surface of the primary cooling channel to purge any vapor films formed thereon. The water exits the primary cooling channel through passages beneath the surface of the casting mold and exits the nozzle so as to bathe the exiting cast strip in coolant.

3 Claims, 7 Drawing Figures

ENVELOPE OPENING APPARATUS AND METHOD

This application is a continuation of application Ser. No. 486,077 filed July 5, 1974, now abandoned, which was a division of application Ser. No. 289,314, filed Sept. 15, 1972 now U.S. Pat. No. 3,822,523.

BACKGROUND OF INVENTION

The present invention applies to apparatus and method for opening envelopes and, more particularly, to improved method and apparatus for handling an envelope to effect opening thereof on three sides.

The volume of mail being handled in the United States is increasing every year at an alarming rate. Many companies, such are credit card companies and oil companies, receive literally thousands of pieces of mail daily. Such companies employ large numbers of people in departments whose only function is to simply open the envelopes and dispatch the contents thereof to the proper departments.

Where companies receive extremely large amounts of mail on a daily basis, even a delay of one day in opening the mail can create very serious problems and be quite costly as well. For example, where financial institutions such as credit card companies and utility companies are involved, a delay in processing the mail thus resulting in a one day's delay in depositing the checks can result in a very substantial loss of interest on such an amount even for one day. Accordingly, the need for a quick and efficient mail opening machine in such instances has become paramount.

Over the past few years, various attempts have been made to design and develop equipment which will mechanically open the mail. Until now, all of these devices have been of a type which essentially open one edge of the envelope. This is accomplished by such means as slitters, abraders, or cutters which engage one side of the envelope.

Onesided envelope openers have not been altogether satisfactory. The primary problem of onesided envelope openers is that the contents are still within the envelope at the time they reach the sorting personnel. Accordingly, the sorting personnel must still expend the time of expanding the panels of the envelope and removing the contents from the envelope. This represents but small saving of time over having the same personnel actually open the one side of the envelope themselves. Additionally, the onesided envelope openers do not dispose of the problem of unobserved contents remaining in the envelope which are not removed. Accordingly, candleing devices and the like are often necessary to insure that all of the contents have been removed.

The desirable form of envelope opener is one which will open the envelope on three sides and lay back both panels of the envelope completely and fully exposing the entire contents of the envelope. An envelope opened in this manner requires the operator only to merely pick up the contents rather than have to fumble with the envelope opened on one side to remove the contents. Additionally, the chances of missed contents become nil when an envelope is opened in this manner.

The problems encountered in the design and operation of a practical three sided envelope opener are significantly greater than that involving the opening of only one side. Three such major problems encountered are firstly, the method of opening or treating the edges of the envelope, secondly, the method and apparatus for handling the envelope by which three edges thereof can be exposed for opening and, thirdly, the manner in which the panels of the envelope themselves are laid back to expose the contents.

As regards the method of opening employed in a three sided opener, a design consideration must be made as to whether or not the three edges will be completely severed and opened initially or merely weakened and opened simultaneously at a final point in the operation. It has been found, in most instances, it is preferable to only weaken the edges of the envelope rather than completely sever and open them during the initial stages. In this manner, loose contents such as coins and credit cards will be retained within the confines of the envelope even though weakened until the final opening operation.

One method which has been found very satisfactory for weakening the edges of the envelope without completely opening them in the preliminary stages is the application of heat to the edges by convection or radiation. Such methods and apparatus for accomplishing this are disclosed in U.S. Pat. No. 3,590,548 and in U.S. application Ser. No. 74,060 filed Sept. 21, 1970 now U.S. Pat. No. 3,875,722.

As more fully explained in the aforementioned U.S. Patent and application, the application of heat to the edges of the envelope tends to dry out the fibers in the immediate vicinity of the edge in a process known as carbonization thus weakening the edges permitting their easy serverance by the application of forces at a later stage. This method is one of the methods employed in the envelope opening apparatus of the present invention. However, other methods of weakening the edges may also be employed as hereinafter described.

The method and apparatus for handling the envelope to treat three sides thereof also presents many problems. One consideration is whether or not to simultaneously treat all three sides of the envelope. Since envelopes are of varying sizes, simultaneous treatment becomes an extremely difficult problem unless a machine is designed to handle only a given size of envelope.

It has been found that, from a practical standpoint, the sides of the envelope must be treated in separate stages. This means that the envelope must be reorientated to a proper position for opening of the respective sides. The reorientation of the envelope presents many problems of handling. Apparatus has been proposed whereby the envelope is rotated from one edge to its second edge and then to a third edge to sequentially present the edges for treatment. However, this apparatus is extremely complex, cumbersome and slow in operation. Various other methods have been tried such as ones involving devices which must reciprocate in their handling of the envelope. Such devices are inherently slow and as such become unsatisfactory.

Lastly, the apparatus which actually effects the separation of the panels themselves involves many design difficulties. One such problem is the presence of stiff members such as coins or cards in the envelope. The opening apparatus must be capable of standing passage of such elements through the machine and also handling such elements without scattering them upon opening them. Such devices as brakes which will shear back one of the panels of the envelope have been proposed. These devices will operate satisfactorily, however, the timing and roller pressures become critical and varying envelope thicknesses may become a problem in their operation.

OBJECTS AND SUMMARY OF INVENTION

It is an object of the present invention to provide apparatus and methods of handling an envelope to present three sides thereof for treatment which can operate at a high speed, will protect the contents of the envelope and also accurately position each of the sides for engagement with the edge treating means.

It is a further object of the present invention to provide apparatus and methods for opening envelopes which have three sides thereof weakened and which is insensitive to hard objects within the envelopes and varying thickness thereof.

The present invention carries out the foregoing object in respect to handling of the envelope by providing an apparatus and method in which positive control of the envelope is never lost. This is accomplished by means of a wheel upon which a plurality of complementary pairs of stationary and moveable, protective paddles are arranged in a circular array. The paddles are designed to open at a feeding station at which an envelope is fed between the stationary and moveable paddles. A stop bar adjacent the paddle positions the leading edge of the envelope slightly exposed from the protective paddles. As the wheel advances in a circular direction, the paddles close in a protective gripping relationship on the envelope and the envelope is transported past a treating station at which the leading and exposed edge of the envelope is weakened.

The envelope then next proceeds with the rotation of the wheel to a transfer station. At this point, the moveable paddle is opened and the envelope is released. Disposed immediately below the paddles at the transfer station is a conveyor moving in a radially outward direction. The envelope, on being released, engages the conveyor and is conveyed against a radially outwardly positioned stop bar. Both the stop bar and the elevation of the conveyor are such that, as the moveable paddles closes upon further rotation of the envelope, the bottom and outer edge of the envelope will be slightly exposed from the paddles surrounding and gripping the envelope. The envelope is then conveyed passed treating means which weaken both the exposed outer edge and bottom edge of the envelope.

The foregoing object in respect to opening of the envelope is carried out in the present invention by means of apparatus which will first induce a shearing force parallel to the panels of the envelope to crack and thereby further weaken the previously weakened edges thereof and then separate the weakened edges by separating forces imposed perpendicularly to the panels of the envelope. The parallel shearing forces are created by conveying the envelope upon a belt which passes over a plurality of idler rollers in a tortious path which causes reverse flexures of the envelope sufficient to crack the weakened edges. The envelope is then conveyed between a conveyor belt and a drum. A vacuum plate beneath the belt cooperates through apertures in the belt to grip the lower panel of the envelope. Apertures within the drum through which a vacuum is induced, in a like manner, grip the top panel of the envelope. As the belt progresses, the diverging path of the belt and the surface of the drum separate the panels. A nip roller following the drum serves to aid in assuring the continuance of the envelope through the opening apparatus. Additionally, a pressure roller following the drum also serves to flatten or iron the envelope panels and contents.

Other objects and advantages of the present invention will become apparent to those skilled in the art from reading the detailed description thereof which follows taken in conjunction with the drawings.

DESCRIPTION OF DRAWINGS

FIG. 8 is a side elevation view of the envelope feeding apparatus shown in FIG. 7;

FIGS. 9 - 11 are a plan view and two side elevation views respectively of a typical roller floor of the present invention;

FIGS. 12A and 12B are side elevation views of the misalignment detector of the present invention;

FIGS. 13 and 14 are a plan view and side elevation view respectively of the details of the paddle and operating means of the present invention;

FIGS. 15 - 17 are a plan view and two side elevation views respectively of the heater assembly for treating the inside edge of the envelope;

FIG. 18 is a side elevation view of a typical envelope edge cleaning apparatus;

FIGS. 19 - 21 are a plan view and two sides elevation views respectively of the heater assembly for treating the outside edge of the envelope;

FIGS. 22 - 24 are a plan view and two side elevation views respectively of the heater assembly for treating the bottom edge of the envelope;

FIGS. 25 and 26 are a plan view and side view respectively of the differential separator of the present invention.

FIG. 27 is a side elevation view of the paddle wheel cleaning assembly of the present invention;

FIG. 28 is a plan view of the apparatus of FIG. 27; and

FIG. 29 is a circuit diagram of the control circuitry of the apparatus of the present invention.

DETAILED DESCRIPTION OF INVENTION

I. GENERAL COMPONENTS AND OPERATION — FIGS. 1-6

Figure 1:
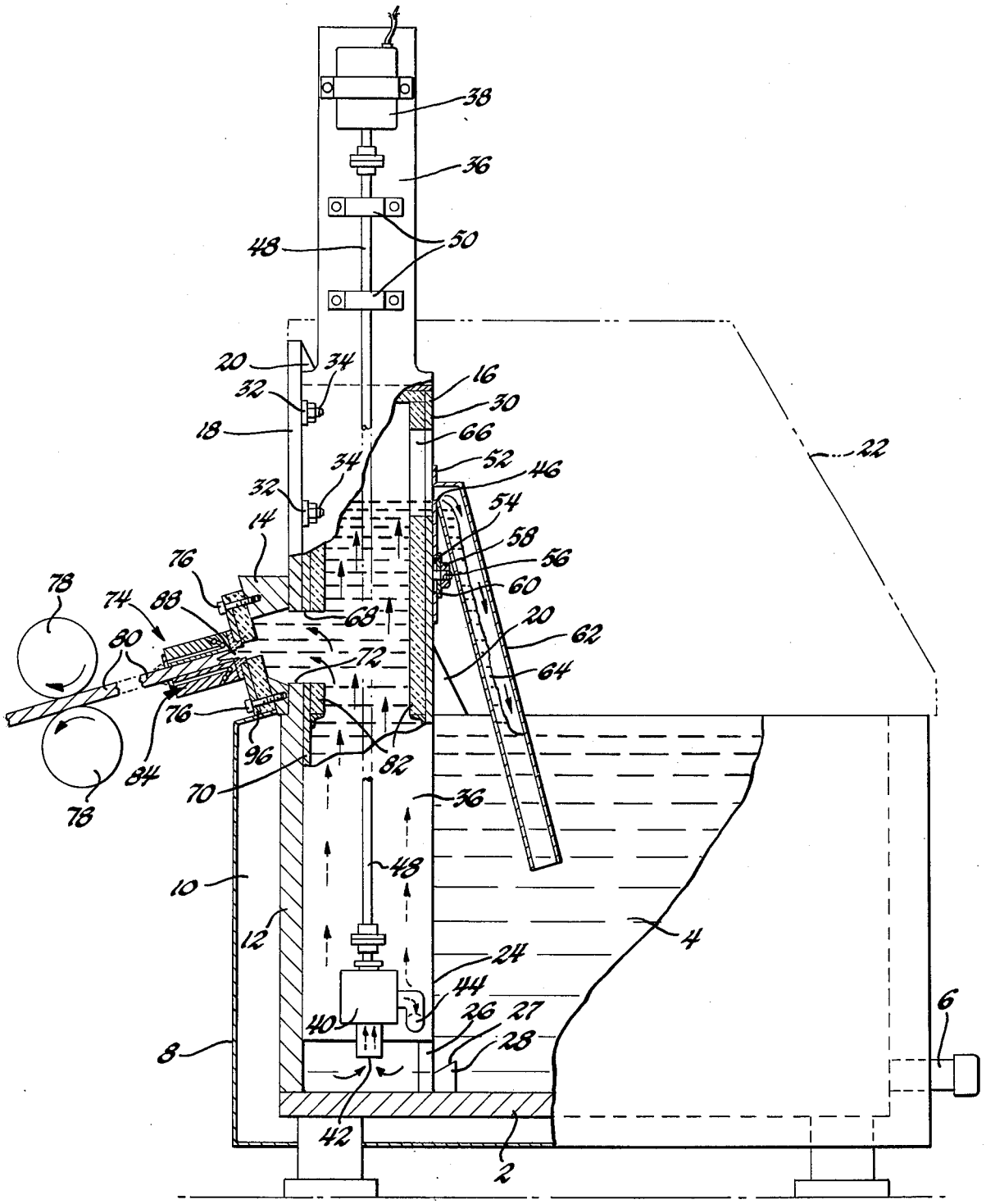
FIG. 1 is a perspective view of the envelope opening apparatus of the present invention assembled in a housing with cooperative feeding and sorting conveyors.

FIG. 1 of the drawings shows the general overall external appearance and arrangement of the major components and assemblies of the envelope opening apparatus of the present invention. The envelope opening mechanism is disposed within a housing 10 and will be described in detail hereinafter. The housing employs doors 11 and 12 which swing outwardly from the center to provide access to the assembly within the housing. The opposite side and adjacent end of the housing as- 114 are coupled to an external source of coolant 110 via inlets 116 shown in FIG. 3. The ports 112 may conveniently be formed in the block 84 by drilling a plurality of access holes 118 (i.e., shown only in FIG. 2) and then sealing the access holes 118 as by a threaded plug 120. Similarly the cooling channels 104 and 114 may be formed the same way as illustrated in FIG. 3 by plugged access holes 122 and 124.

Coolant exits the primary channel 104 and the body 84 via a plurality of subsurface (i.e., mold surface 128) cooling passages 126 extending from the primary cooling channel 104 to the outlet end 90 of the body 84 to remove heat from the mold cavity 86 and promote continued solidification of the metal throughout the cavity 86. To promote still further cooling of the strip 80 the coolant exiting the passages 126 engage a baffle plate 130 at the outlet end 90 of the mold cavity 86 and is deflected onto the solidified strip 80 shortly after it exits the casting nozzle.

FIGS. 4–7 relate to casting nozzle and throat assemblies 74 particularly adapted for the continuous casting of low melting, low strength metals such as lead and have proved effective in the casting of Pb-Ca-Sn (i.e., 99+% Pb) strips (i.e., 3.2 in × 0.75 in) at temperatures of about 670° F.–700° F. at rates up to about 8 ft/min. More specifically, the casting nozzle and throat assemblies 74 of FIGS. 4–7 all include a smooth, snag-resistant sealing member 132 at the inlet end 88 of the mold cavity 86, which sealing member 132 comprises an aromatic polyimide resin which is thermally stable at the casting temperature of the lead. Suitable polimides include those marketed commercially as Tribolon®, Thermamid® and Vespel® with the latter being most preferred for extended casting runs in the aforesaid 670° F.–700° F. temperature range. In this regard the Vespel® material is more durable than other materials tested in that it required less frequent replacement than the others and could last eight hours or more without replacement or regrinding for another casting run. More specifically yet, excellent results have been achieved using filled or unfilled versions of the polyimide material marketed by DuPont Co. as Vespel SP-1 which is a high aromatic polymer of poly-N,N'(P,P'-oxydiphenylene) pyromellitimide having the general formula $[(C_{22}H_{10}O_5N_2)]_x$. This material has a thermal stability exceeding 700° F., as determined by thermal gravimetric analysis at a heating rate of 15° C./min in an 80 ml/min air stream. The Vespel SP-1 material is further characterized by a density of about 1.42 to 1.44 g/cc (ASTM-D792), a Rockwell E hardness of about 45–75 (ASTM-D785), a tensile strength of at least 9,000 psi (ASTM-D-1708), a minimum 3.5% elongation (ASTM-D1708), and a heat deflection of about 680° F. (ASTM-D648). Seals with as much as about 15% by weight graphite (i.e., about 5 microns) filler seem to perform the best. One such material (i.e., Vespel SP-21) has a density of about 1.49 to 1.52 g/cc, a Rockwell E hardness of about 25–55, a minimum tensile strength of about 5,200 psi and a minimum 1.7% elongation.

Figure 2:
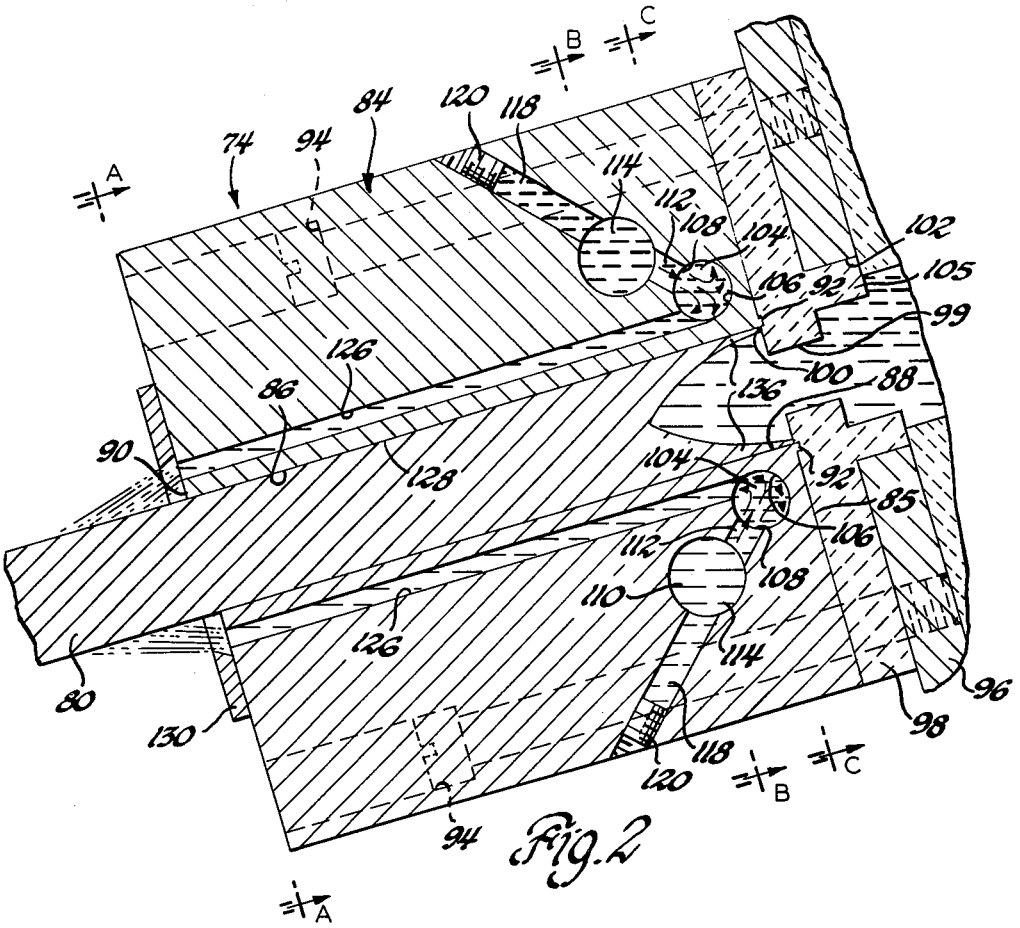
FIG. 2 is a plan view showing the relative positions of the various components of the envelope opening apparatus one to another and as respects the remaining figures of the drawings.
Figure 3:
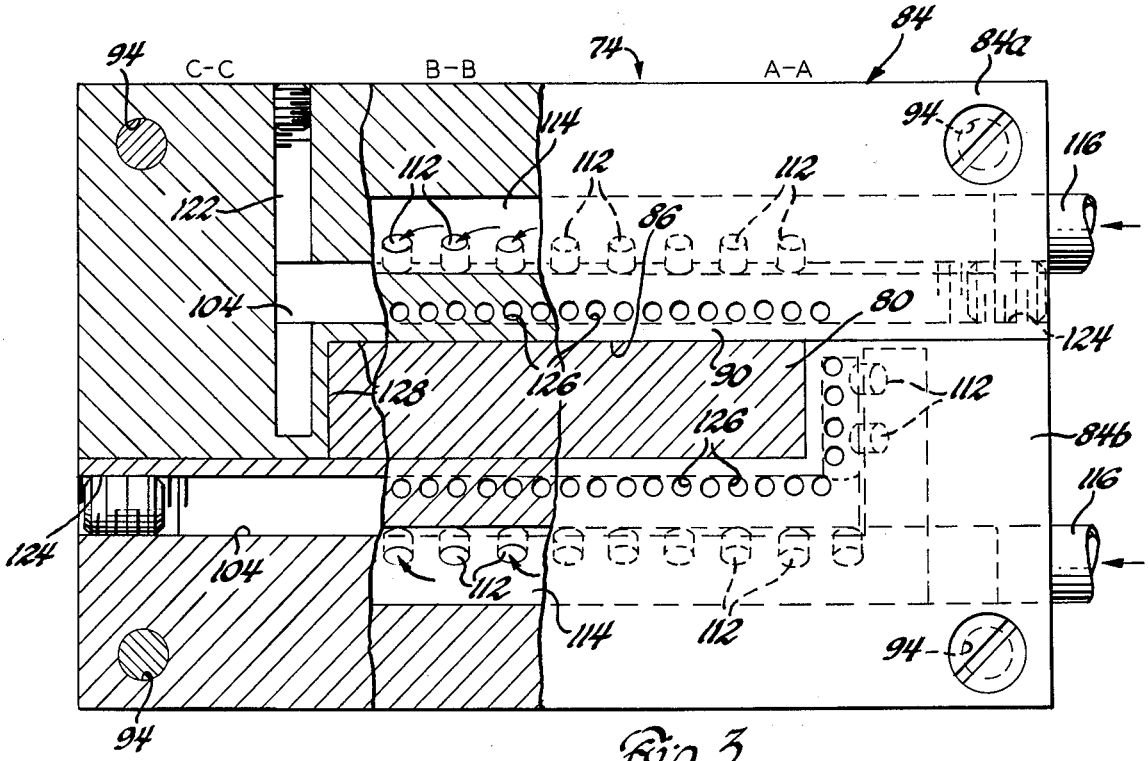
FIG. 3 is a side elevation view of the opening taken along the line at 3—3 of FIG. 2.
Figure 4:
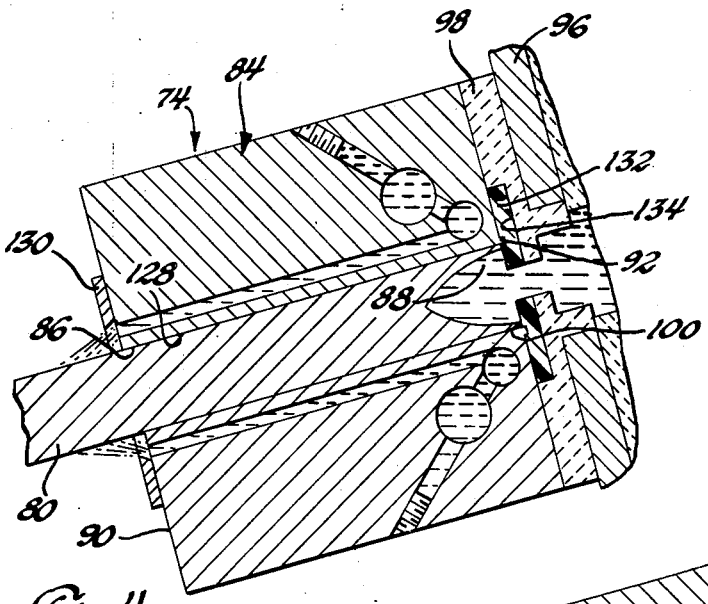
FIG. 4 is a side elevation view of the apparatus of the present invention taken along the line 4—4 of FIG. 2.
Figure 5:
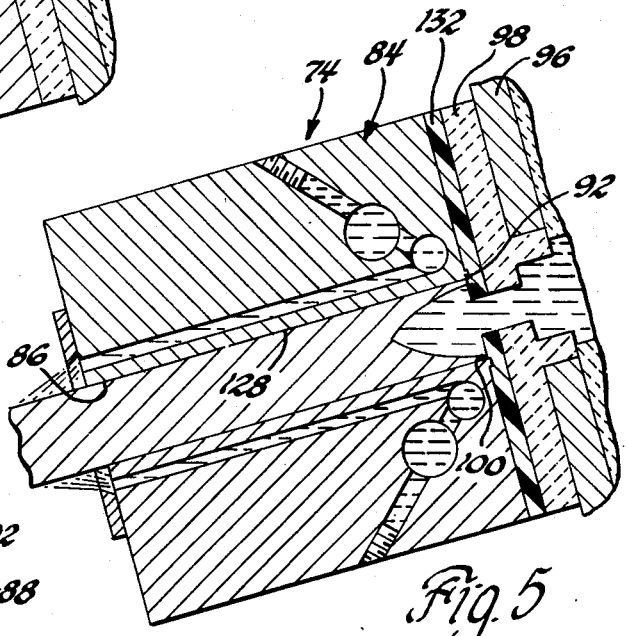
FIG. 5 is a side elevation view of the envelope opening apparatus taken along the lines 5—5 of FIG. 2.

FIGS. 4 and 5 show essentially the same casting nozzle and throat assembly 74 as described in conjunction with FIGS. 2 and 3, but with the polyimide seals 132 positioned at the inlet 88 to the mold cavity 86 and forming the casting throat as shown. More specifically, FIG. 4 has the polyimide seal 132 positioned in a recess 134 formed in the Marinite insulator 98, whereas FIG. 5 has the polyimide seal 132 as a single plate filling the entire space between the nozzle 84 and Marinite insulator 98. In both instances, however, as also with FIGS. 6 and 7, the lands 92 compress the polyimide seal 132 to form a substantially perfect seal at the freezing junction 100 which prevents the molten lead from creeping between the seal and the body 84 to form flash or other potential sources for snagging or rupturing the thin, weak skin 136 solidifying at the junction 100. Such snagging, rupturing etc. of the skins can cause unacceptable defects to be formed on the casting and significantly reduce the casting rate.

The casting nozzle and throat assemblies 74 of FIGS. 4 and 5 has proved effective for casting at rates up to about 3½ ft/min. At higher rates, there is a tendency to produce vibration in the nozzle 84. At certain amplitudes, this vibration has proved quite beneficial in permitting higher casting rates, but the structures shown in FIGS. 4 and 5 did not permit constant control of the vibration within the beneficial range. Rather, the vibrations obtained with the FIG. 4 and 5 devices above about 3.5 ft/min casting rate were unstable and changed in both amplitude and frequency at random during a single casting run and tended to cause large casting defects and aborted casting runs.

While the exact cause of the vibration is not entirely understood, it is believed to be the result of a freeze-shrink mechanism occurring within the nozzle. In this regard, the lead apparently freezes against the surface 128 of the mold cavity 86 and then as freezing continues it shrinks away from the surface 128. But when the shrinking occurs, the heat and pressure from the molten core behind it pushes the lead "skin" back against the surface 128 and the process repeats itself. This action is apparently the source of the vibration and the vibration itself is transmitted back into the sealing plate, where, due to its elasticity, it is amplified and transmitted into the casting at the mouth of the mold 88 where the skin is the thinnest and most vulnerable to rupture.

Figure 6:
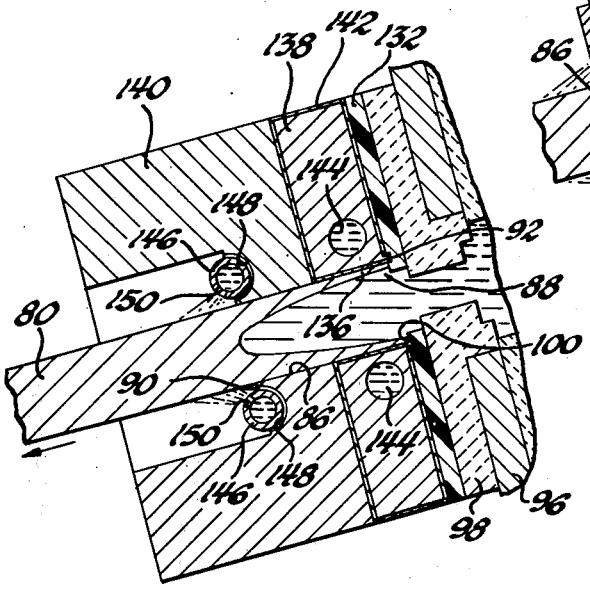
FIG. 6 is a plan view of the supporting equipment positioned below the apparatus shown in FIG. 2 and as taken along the lines 6—6 of FIG. 5.
Figure 7:
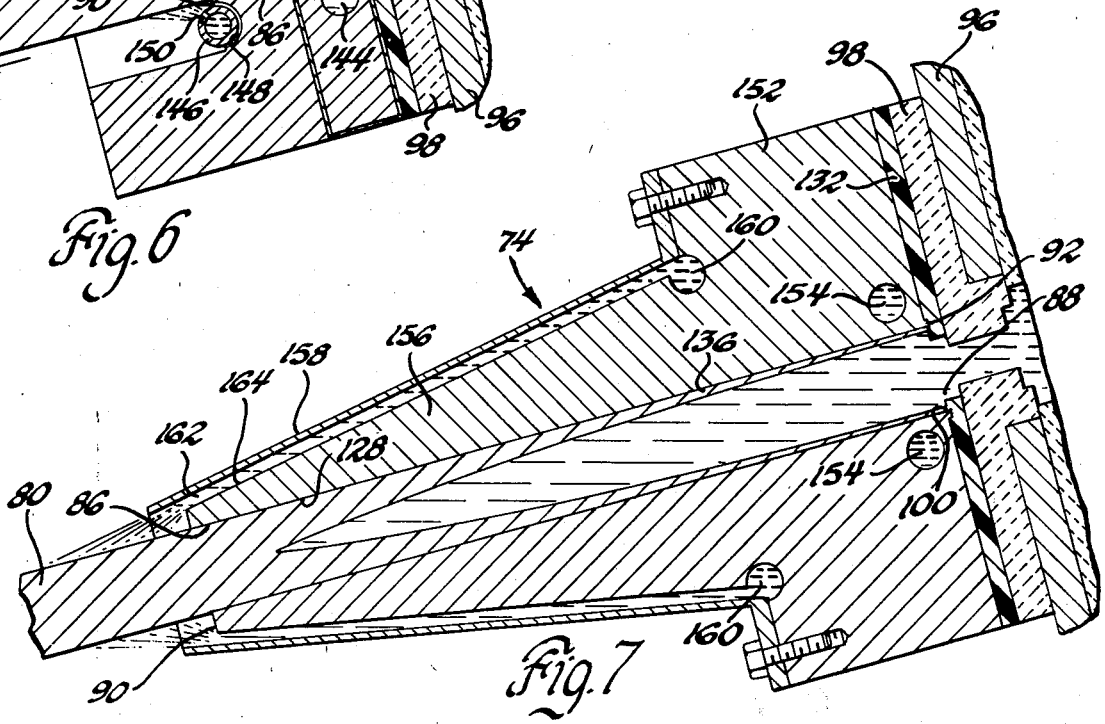
FIG. 7 is a plan view of the envelope feeding apparatus of the present invention.

The casting nozzle and throat assemblies of FIGS. 6 and 7 permit casting speeds of about 8 ft/min using the polyimide sealing plate 132. The casting nozzle of FIG. 6 was designed to eliminate the vibration and did so by virtually eliminating the aforesaid "freeze-and-shrink" action. By comparison to the others, the FIG. 6 nozzle is short and adopted to very rapid cooling of the melt. Moreover, the mold cavity 86 was tapered from a maximum at the inlet 88 to a minimum at the outlet 90 and at a rate commensurate with the shrinkage rate of the cast strip thereby maintaining the metal-to-mold surface contact throughout the length of the nozzle. The nozzle itself comprises two distinct metal sections 138 and 140. Section 138 comprises a highly thermally conductive copper alloy body at the melt entrance to rapidly freeze the melt and form a thick initial skin 136. A thin chrome electrodeposit 142 is provided over the copper body to protect it from alloying, soldering, or the like with the lead melt. As before, a cooling channel 144 is provided around the inlet 88 of the mold cavity and in close proximity to the freezing junction 100 between the polyimide sealing plate 132 and the metal section 138. The second metal section 140 of the nozzle comprises stainless steel which is both thermally conductive and capable of withstanding prolonged casting runs without deterioration. Only a small portion of the stainless steel contacts the strips 80 with the remainder acting as a heat sink for the heat transmitted from the melt. Cooling of the small sections and the strip itself is provided by coolant conduits 146 which are provided in depressions 148 at the exit of the nozzle and ports 150 are provided in the conduits 146 for spewing the coolant onto the lead strip as it exits the nozzle.

The embodiments shown in FIG. 7 overcomes the 3½ ft/min casting rate limitation imposed by the vibration of the polyimide by stabilizing that vibration at levels which aid casting. Here, the nozzle body is made from aluminum and comprises a relatively large base portion 152 adjacent the melt source (i.e., near the inlet end 88 of the mold cavity 86). A cooling channel 154 is provided in the base portion 152 circumscribing the freeze junction 100. The remainder of the nozzle tapers externally as at 156 from the base portion 152 to the exit end 90 of the mold cavity. The tapered portion 156 of the nozzle is encased in a conforming sheet metal shroud 158. A secondary coolant 162 is introduced into channels 160 provided at the base of the shroud 158 and confined by the shroud 158 flows in a continuous sheet over the entire external surface 164 of the tapered portion 156. The coolant exits the nozzle so as to spray upon the solidified casting for still further cooling. The FIG. 7 structure provides a slow, controlled cooling of the melt and a prolonged formation of a thin skin 136. The effect of this slow cooling in the elongated (e.g., 9–12 in) tapering nozzle is to provide a very large contacting surface area 128 where the "freeze-shrink" action can occur which has proven successful in stabilizing the vibration to the point of permitting casting speeds of up to about 8 ft/min. While effective to produce higher casting rates these longer nozzles do have a tendency to form oxide and lead deposits on the inner surface 128 of the mold cavity which tend to affect the stability of the vibrations.

While the invention has been disclosed primarily in terms of specific embodiments thereof, it is not intended to be limited thereto but rather only to the extent hereinafter set forth in the claims which follow.

We claim:

1. A nozzle for continuously casting lead strip from a lead melt, said nozzle being adapted for cooling with a coolant readily vaporizable at the melting temperature of the lead and comprising: a metal body defining an open-ended mold cavity having a melt inlet and a strip outlet; a first cooling channel formed in said body at and circumscribing said inlet, said channel having a hot surface closest to the melt in the inlet and a colder surface opposite said hot surface; a second cooling channel in said body generally paralleling said first channel near the cold surface thereof for supplying said coolant under pressure to said first channel; means for supplying said second cooling channel with coolant, under pressure; and a plurality of ports intermittantly interconnecting said channels along substantially the full lengths thereof and through said cold surface, and being adapted to direct high velocity streams of said coolant against said hot surface to purge said hot surface of any vapor films formed thereon.

2. A nozzle for continuously casting lead strip from a lead melt, said nozzle being adapted for cooling with a coolant readily vaporizable at the melting temperature of the lead and comprising: a metal body defining an open-ended mold cavity having a melt inlet and a strip outlet; a first cooling channel formed in said body at and circumscribing said inlet, said channel having a hot surface closest to the melt in the inlet and a colder surface opposite said hot surface; a second cooling channel in said body generally paralleling said first channel near the cold surface thereof for supplying said coolant under pressure to said first channel; means for supplying said second cooling channel with coolant, under pressure; a plurality of ports intermittantly interconnecting said channels along substantially the full lengths thereof and through said cold surface and being adapted to direct high velocity streams of said coolant against said hot surface to purge said hot surface of any vapor films formed thereon; and cooling passages extending from said first channel to the outlet end of the mold such as to cool the cavity with coolant from said first channel and bathe the strip exiting said outlet with said coolant at a location remote from said outlet.

3. In apparatus for continuously casting a strip of lead including a chillable mold for the solidification of the lead from a melt thereof, means for providing a continuous supply of said melt to said mold, insulating means between said mold and supply for substantially thermally isolating said mold from said supply means and a slot through said insulating means for passing melt from said supply means to said mold, the improvement comprising said mold comprising:

a metal body;

at least one internal wall defining a mold cavity extending through said body between a melt inlet end and a strip outlet end;

said inlet end being adjacent said insulating means and including a corner portion adjacent to and circumscribing said slot, said corner portion serving to initially extract sufficient heat from the melt passing through said slot to form a skin against said wall at said corner said skin having sufficient strength to permit pulling of said strip in the direction of said outlet without rupturing said skin;

a first cooling channel in said body immediately subjacent the entirety of said corner for conducting coolant just beneath said corner for the rapid removal of heat from said corner, said channel having a hot surface closest said corner and a colder surface opposite said hot surface;

a second cooling channel in said body and generally paralleling said first channel near the cold surface thereof for removing additional heat from said inlet end at locations more remote from said corner than said first channel, and for supplying cooling water under pressure to said first channel;

conduit means for providing coolant to said second cooling channel, under pressure;

a plurality of ports intermittantly spaced along the lengths of said channels interconnecting said second channel to said first channel through the cold surface thereof and effective to direct high velocity streams of said coolant against said hot surface to purge said hot surface of any coolant vapor films formed thereon; and a plurality of cooling passages beneath the surface of said wall extending from said first channel to said strip outlet end, said passages being so terminated at said strip outlet end as to direct coolant flowing therethrough onto said strip at a location remote from said outlet end such that said coolant cannot wick-up said strip into said mold and vaporize therein.

* * * * *

UNITED STATES PATENT AND TRADEMARK OFFICE

CERTIFICATE OF CORRECTION

PATENT NO. : 4,122,890

DATED : October 31, 1978

INVENTOR(S) : Larry P. Atkins, et al

It is certified that error appears in the above–identified patent and that said Letters Patent are hereby corrected as shown below:

Columns 1 thru 4 should be deleted to insert the attached Columns 1 thru 4 respectively therefor.

Signed and Sealed this

*Twenty-fifth* Day of *December 1979*

[SEAL]

*Attest:*

SIDNEY A. DIAMOND

*Attesting Officer*

*Commissioner of Patents and Trademarks*

NOZZLE FOR THE CONTINUOUS CASTING OF LEAD

BACKGROUND OF THE INVENTION

This invention relates to nozzles for the continuous casting of lead strip, and more particularly to means for cooling same with coolants (e.g., water) which are readily vaporizable at the melting point of the lead.

In the continuous casting of lead strip a lead melt is introduced into the inlet of a casting nozzle having a chilled surface therein defining a mold cavity therethrough for solidifying the melt. The casting nozzle is thermally isolated from the melt source by a refractory material and melt passing through the refractory begins to solidify as a thin skin at the inlet of the chilled nozzle, which skin grows inwardly as the metal progresses through the nozzle and finally immerges the nozzle as a solidified strip. The inlet of the cavity adjacent the refractory is one of the most critical regions of the nozzle as it is the locus of the formation of the initial solid skin which permits pulling of the strip from the nozzle. The strength of the skin at the inlet plays a significant role in the rate at which the strip can be cast which in turn is a function of the metallurgical properties (e.g., tensile strength, etc.) of the metal itself and the thickness of the skin at the inlet. The combination of metallurgical properties and thickness of the skin at the inlet determines the amount of pull the skin can withstand before rupturing. Skin rupture can cause the melt source to become "unplugged" and dump through the nozzle or otherwise create unacceptable defects on the cast strip. In the case of metallurgically weak metals such as lead or its alloys (hereafter lead), skin strength at the inlet is achieved primarily by thickness, and thickness is achieved by maximum heat removal at the inlet of the nozzle. The inlet, however, is also the hottest part of the nozzle and hence tends to vaporize preferred coolants such as water in the cooling channels, and with the formation of insulating vapor films in the cooling channels circumscribing the inlet the heat removal rate is substantially diminished.

It is therefore an object of the present invention to provide an improved cooling arrangement for casting nozzles which maximizes the effectiveness of the coolant in the total solidification process, but primarily in the region of the nozzle inlet where the invention insures that coolant flows in a turbulent, vapor-film-purging manner in the cooling channel circumscribing the inlet.

This and other objects and advantages of the invention will become more readily apparent from the description which follows and particularly as it relates to FIGS. 3 and 4 hereof.

THE INVENTION

In accordance with the present invention, a continuous lead casting nozzle has its cooling system arranged to maximize the heat removal at the inlet to the casting nozzle by removing any heat transfer limiting vapor films formed in the system. More specifically, the casting nozzle body is provided with: a first cooling channel circumscribing the inlet to the mold cavity in the casting nozzle; a second cooling channel spaced from but paralleling the first cooling channel; a plurality of ports intercommunicating the first and second channels and so arranged that coolant enters the first channel from the second channel through the ports so as to be directed against the hottest surface of the first channel in so turbulent a manner as to purge that surface of any heat transfer restricting vapor films formed thereon. In a preferred embodiment, the coolant exits the first channel through cooling passages located just beneath the walls of the mold cavity to cool the mold cavity and hence the metal therein as it traverses and solidifies within the nozzle. Finally the nozzles are so structured that the coolant exiting the nozzle is directed onto the solidified strip downstream of the nozzle for still further and final cooling thereof.

DETAILED DESCRIPTION

FIG. 1 is a partially broken away and sectioned side elevational view of a continuous casting apparatus illustrative of the invention;

FIG. 2 is an enlarged, side sectional view of the casting nozzle and throat assembly of FIG. 1;

FIG. 3 is the casting nozzle of FIG. 2 broken away in the three planes A—A, B—B, and C—C of FIG. 2;

FIGS. 4–7 are side, sectional views of casting nozzle and throat assemblies useful for the continuous casting of lead from devices such as shown in FIG. 1. To the extent possible, the same reference numerals are used to designate similar structures in different embodiments.

FIG. 1 depicts a continuous caster including a heated reservoir 2 for holding a melt 4 at a predetermined temperature. The reservoir may be lined with insulating brick or the like (not shown) depending on the composition and temperature of the melt 4. A capped drain pipe 6 is provided at one end of the reservoir 2 for emptying during off periods and for maintenance. The reservoir 2 is encased in sheet metal 8 which provides an insulating air gap 10 thereabout. One of the walls 12 defining the reservoir 2 extends vertically upward and serves to support a casting chamber block 14 on one side thereof and a casting standpipe 16 on the other side thereof. Braces 20, on either side of the standpipe 16, are appropriately affixed to the other reservoir walls and serve to reinforce the vertical extension 18. The reservoir 2 and standpipe 16 are covered by a shroud 22 (shown in phantom) to minimize heat losses and contain controlled atmospheres (e.g., argon), which may desirably be employed over the melt 4 to reduce drossing thereof.

The casting standpipe 16 has its lower end 24 submerged below the level of the melt 4 in the reservoir 2 and supported above the bottom of the reservoir 2 on the pedestal 26. When the standpipe is inserted into the reservoir 2 the pedestal 26 engages the inclined surface 27 of a positioning block 28 on the floor of the reservoir 2. The inclined surface 27 causes the lower end 24 to move against the wall 12 and drop into place between the wall 12 and the block 28 for securing the lower end 24 in place. The upper end 30 of the standpipe 16 is provided with earlike flanges 32 for securing the standpipe to the vertical extension 18 via threaded studs 34.

One of the walls 36 (here forefront) of the standpipe 16 (which is rectangular in horizontal cross section) extends above and beyond the remainder of the standpipe 16 and conveniently serves to mount a reversible motor 38. The motor 38 is connected by a drive shaft 48 to a reversible pump 40 at the bottom of the standpipe 16. The drive shaft is journalled, as at 50 and as necessary, along the length of the wall 36. The pump 40 has an inlet 42 for receiving melt 4 from the reservoir 2 and an outlet 44 for delivering that melt into the standpipe 16 and pumping it upwardly therethrough during casting to an overflow weir 46 located near the top of the standpipe 16 and above the casting zone adjacent the casting chamber block 14. To abort a casting or shut down the caster the motor and pump are reversed and the flow reversed in the respective inlet and outlet.

Height of the melt in the standpipe 16, and hence the metalostatic head in the casting zone, is controlled by the location of the weir 46 which is adjusted by moving a slide plate 52 up or down along the side of the standpipe 16 to position the weir 46 as desired at the melt exit opening 66 near the top of the standpipe 16. An elongated vertical slot 54 is provided in the slide plate 52 through which a threaded stud 56 on the side of the standpipe 16 extends. A nut 58 and washer 60 serve to clamp the plate 52 to the outside wall of the standpipe 16 in the desired location. Downcomer 62 is appropriately attached to the slide plate 52 adjacent the weir 46 for conducting the melt overflow 64 back to the melt 4 in the reservoir 2. A port 68 through the wall 70 and insulation 82 of the standpipe 16 is registered with a like port in the vertical extension 18 and serves to supply melt from the standpipe 16 to a casting nozzle and throat assembly 74. The casting nozzle and throat assembly 74 is affixed to the casting block 14 as by bolts 76, or appropriate quick-disconnect means. The casting block 14 may be heated to more precisely control the temperature of the melt just prior to entering the mold. Casting nozzle and throat assemblies 74 are discussed in more detail hereinafter in conjunction with the other figures.

In operation, the reservoir 2 is filled with melt 4 to an appropriate level and its temperature maintained at a predetermined level therein by appropriate heaters (not shown). Pump 40 is then energized so as to circulate melt from the reservoir 2 upwardly through the standpipe 16, over the weir 46 and through the downcomer 62 back to the melt 4. The pumping rate is such as to insure a volumetrically flow rate (i.e., $ft^3$/min) into the standpipe 16 which is higher than the volumetric removal rate of the metal as strip 80 and thereby insure a continuous stream of overflow melt 64 returning to reservoir 2. The flow rate is preferably held constant at a rate which exceeds the maximum casting rate capability of the caster and hence only the overflow rate will vary as the casting rate varies. Casting is commenced by inserting an appropriate starter strip into the outlet of casting nozzle assembly 74 and causing the melt flowing into the assembly to attach itself to the starter strip. The starter strip is then engaged by pull rollers 78 and withdrawn from the casting nozzle assembly 74 at a rate determined by the speed of the rollers 78 — slowly at first and then increasingly until full casting speed is achieved. The casting rate (i.e., ft/min) of the strip 80 is determined by the ability to pull the strip 80 out of the nozzle assembly 74 without tearing or rupturing the thin skin of solidified metal initially formed at the melt inlet end 88 of the assembly 74.

Automatic control and starting of the caster may be accomplished by means of appropriate sensors and timers (not shown). In this regard, the molten metal pump 40 is energized and the melt level in the standpipe 16 rises to above the opening 68 at which time a level sensor detects the presence of the metal and energizes the rolls 78 at slow speed so as to slowly withdraw the starter strip. After a suitable timed delay sufficient to allow the melt level in the standpipe 16 to reach the overflow weir 46, the speed of the rolls 78 is increased to the desired casting speed. Upon stopping or aborting of the casting the pump 40 is reversed causing the melt level in the standpipe 16 to drop to the aforesaid level indicator which stops the rolls 78. Pumping would continue until after an appropriate timed delay to empty the standpipe at which time the pump 40 would shut down.

The casting nozzle and throat assembly 74 of FIG. 1 is enlarged and detailed more in FIGS. 2 and 3. This nozzle and throat assembly is particularly adapted for use with low melting point metals such as lead and alloys thereof (i.e., hereafter lead) and coolants which are readily vaporizable at the temperature of the melt in the casting zone. The casting nozzle itself comprises a heat conductive metal body 84, which may conveniently be formed from two L-shaped portions 84*a* and 84*b* bolted (not shown) together as best illustrated in FIG. 3. The metal body 84 has internal surfaces 128 defining a mold cavity 86 into which the melt enters at an inlet end 88 and exits solidified as strip 80 at outlet end 90. The body 84 has a sealing face 85 at the inlet end 88 which is provided with a sharp edged sealing land 92 around the periphery of the mouth of the mold cavity 86. The body 84 is bolted (i.e., through bolt holes 94) to a steel mounting plate 96 but spaced therefrom by a refractory, thermally insulating spacer 98 which preferably comprises Marinite (i.e., an asbestos-silica material). The refractory spacer 98 has an orifice 99 therethrough which comprises the casting throat for admitting melt to the mold cavity 86 from the casting block 14. A tight seal is required between the body 84 and the insulator 98 where they meet (hereafter freezing junction 100) at the mouth of the mold cavity 86 and where initial solidification occurs in the form of a thin skin 136. To this end, the body 84 is bolted tightly to the mounting plate 96 so as to sandwich the insulator 98 therebetween and impress the land 92 into the insulator 98 thereby providing a sharp, clean junction 100 for initiating freezing and skin formation. The insulator 98 has an elevated portion 105 around the orifice 99 which conforms to the inside of, and nests within, an opening 102 in the mounting plate 96 so as to insulate the melt against chilling by the mounting plate 96.

The metal body 84 includes means for cooling the mold cavity 86, especially at the mouth thereof near the freezing junction 100. More specifically, a primary cooling channel 104 is provided around the inlet 88 to the mold cavity 86 and as close as possible to the freezing junction 100. During casting the surface 106 of channel 104 closest to the freezing junction 100 is the hottest and is diametrically opposed to a cooler surface 108 more remote from the junction 100. It has been found that the hot surface 106 becomes so hot during casting that readily vaporizable coolants 110 (e.g., water) vaporize upon contact therewith and in so doing form a thin insulating gaseous film on the surface 106 which substantially reduces the heat transfer from the surface 106 to the coolant 110. A plurality of ports 112 are therefor provided through the cool wall 108 along the full length of the channel 104 and such that the coolant 110 is admitted to the channel 104 therethrough and in such a manner as to impinge against the hot surface 106 and scrub away the gaseous, insulating film thereon. Coolant 110 is admitted to the ports 112 from a secondary cooling channel 114 formed in the body 84 so as to substantially parallel the primary cooling channel 104. In addition to providing coolant to the ports 112, the secondary cooling channel 114 serves to remove additional heat from the body 84 at regions more remote from the freezing junction 100 than the primary cooling channel 104. The secondary cooling channels